United States Patent [19]

Wagner

[11] 4,161,833

[45] Jul. 24, 1979

[54] CUTOUT DISPLAY DEVICE

[75] Inventor: Kenneth E. Wagner, Williamsville, N.Y.

[73] Assignee: Carton-Craft Corp., Buffalo, N.Y.

[21] Appl. No.: 838,067

[22] Filed: Sep. 30, 1977

Related U.S. Application Data

[63] Continuation of Ser. No. 687,525, May 18, 1976, abandoned.

[51] Int. Cl.[2] ..... G09F 1/08

[52] U.S. Cl. ..... 40/539; 40/124.1

[58] Field of Search ..... 40/539, 124.1, 421; 46/17, 22; 428/43

[56] References Cited

U.S. PATENT DOCUMENTS

| | | | |
|---|---|---|---|
| 1,499,891 | 7/1924 | Storer | 40/124.1 |
| 1,990,671 | 2/1935 | Redington | 40/539 |
| 2,148,279 | 2/1939 | Sandberg | 40/124.1 |
| 3,422,563 | 1/1969 | Kiley | 46/17 |
| 3,440,747 | 4/1969 | Oliver | 40/539 |

FOREIGN PATENT DOCUMENTS

| | | | |
|---|---|---|---|
| 14258 | 6/1911 | United Kingdom | 40/539 |

*Primary Examiner*—John F. Pitrelli

*Attorney, Agent, or Firm*—Christel, Bean & Linihan

[57] ABSTRACT

A cutout display figure is adapted to be mounted in an erect position on a supporting base. The figure is imprinted on a rigid panel of paper base material and is outlined for the most part by cutout portions which provide open areas surrounding and defining the major part of the outline of the cutout figure. The remainder of the outline of the figure is joined to the surrounding panels along score lines which facilitate separating the surrounding panel from the cutout figure. The lower end of the cutout figure has a tab extension and the panel includes a base member having a slot for receiving the tab extension to support the figure in upright position.

1 Claim, 4 Drawing Figures

CUTOUT DISPLAY DEVICE

This is a continuation of application Ser. No. 687,525 filed May 18, 1976 now abandoned.

BACKGROUND OF THE INVENTION

The present invention relates to a display device wherein a cutout figure is formed as a part of a relatively rigid panel and is separable therefrom and adapted to be associated with a base member which is likewise a part of said panel, the figure being held in an upright position on said base for display purposes.

It is known to print or otherwise reproduce figures representing persons or objects on a sheet of paper or thin cardboard, the figures being outlined by score lines so that they may be separated from the sheet. Such figures normally are on somewhat flexible material in order that the figure may be torn from the base sheet. However, this makes it difficult to maintain the figures in an upright position after they are torn from the base sheet and this renders such devices of very limited usefulness. Examples of such prior art display devices are found in Redington U.S. Pat. No. 1,990,671 and Oliver U.S. Pat. No. 3,440,747.

In prior art devices of this type the thickness of the paper or cardboard which bears the imprint of the figure to be separated therefrom and which is scored to facilitate such separation is limited by the necessity that the support and the figure be relatively flexible to permit separation along the score lines. In such devices of the prior art if the supporting panel and the contained figure are not flexible the figure cannot be separated therefrom without the liklihood of bending or breaking the figure during the separating process.

SUMMARY OF THE INVENTION

The present invention provides a display device wherein the figure appears on a panel of relatively rigid self-sustaining material which may, for instance, be laminated cardboard or chipboard of a thickness of approximately 3/16 of an inch or more. This is accomplished by arranging the figure and the support panel so that the major portion of the outline of the figure is completely separated from the adjacent portions of the supporting panel by die-cuts so that only a minor portion of the outline of the figure is joined with the support panel by score lines.

Accordingly, in one form of the present invention the cutout figure may be separated from the supporting panel by providing a score line extending in from the margin of the supporting panel to the cutout figure whereby the panel may be broken at this score line and thence peeled away from the cutout figure, the minor scored portions of the joinder between the cutout figure and the support panel being thus readily separated to leave the rigid and self-sustaining figure intact for use as an upright display device.

In one form of the invention the panel surrounding the cutout figure includes a portion which serves as a base for supporting the cutout figure. This base may be separated from the supporting panel along appropriate score lines in the process of separating the surrounding panel from about the cutout figure. In the present instance the portion of the panel which forms the base is provided with a die-cut slot into which the lower end of the rigid, self-sustaining figure may be inserted to be supported thereby.

DESCRIPTION OF THE ILLUSTRATED EMBODIMENT

Figure 1:
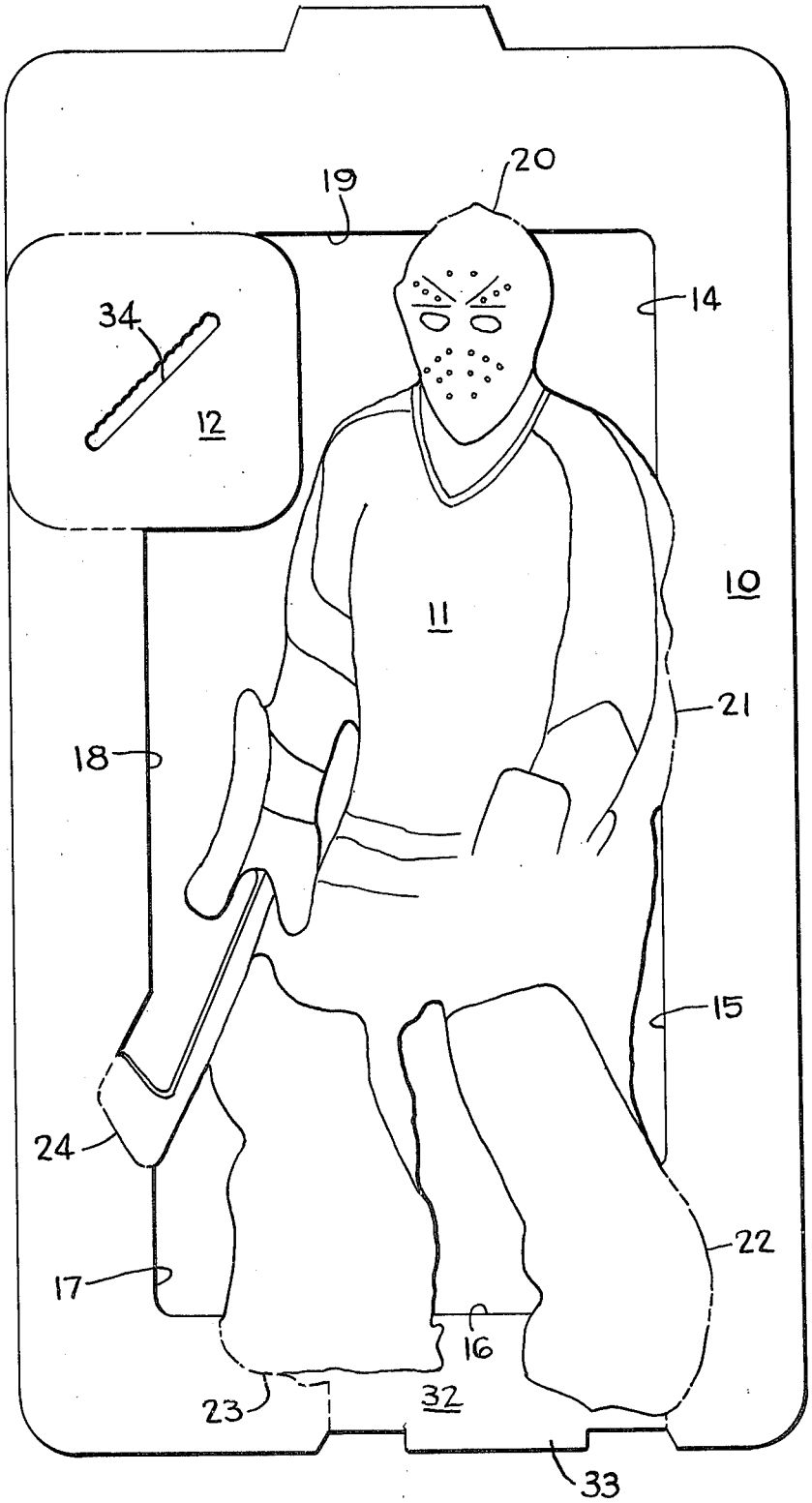
FIG. 1 is a general elevational view of one form of a complete panel of the present invention before separation of the cutout figure therefrom.

FIG. 1 shows a relatively rigid paperboard panel 10 having a sports figure or the like imprinted thereon, in the present instance a hockey player designated 11. The base upon which the figure 11 may ultimately be supported is likewise included in panel 10 and is designated 12 in the drawings.

It will be noted that the figure 11 is outlined for the most part by a series of die-cuts 14 through 19 so that only a minor portion of the outline of the figure 11 actually connects directly with the surrounding panel. These points of actual connection are designated 20 through 24 and comprise score lines for facilitating separation of the figure from the surrounding panel 10.

Figure 4:
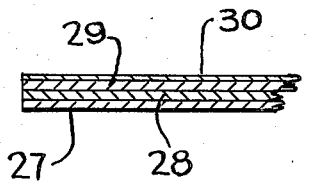
FIG. 4 is a fragmentary edge view of a portion of the panel or cutout figure of FIGS. 1 through 3.

As illustrated in the embodiment shown in the drawings and as shown in detail in FIG. 4 the panel in the present instance comprises three laminations of chip board designated 27, 28 and 29 with a printed cover-sheet 30.

Fabricating the panel of three separate laminations and a cover sheet as described above is done to facilitate die-cutting and scoring the resultant panel thus the score lines are formed in each lamination before the laminations are adhesively secured to form the entire panel which, as is clearly shown and described, are of such thickness to be relatively rigid and inflexible.

Figure 2:
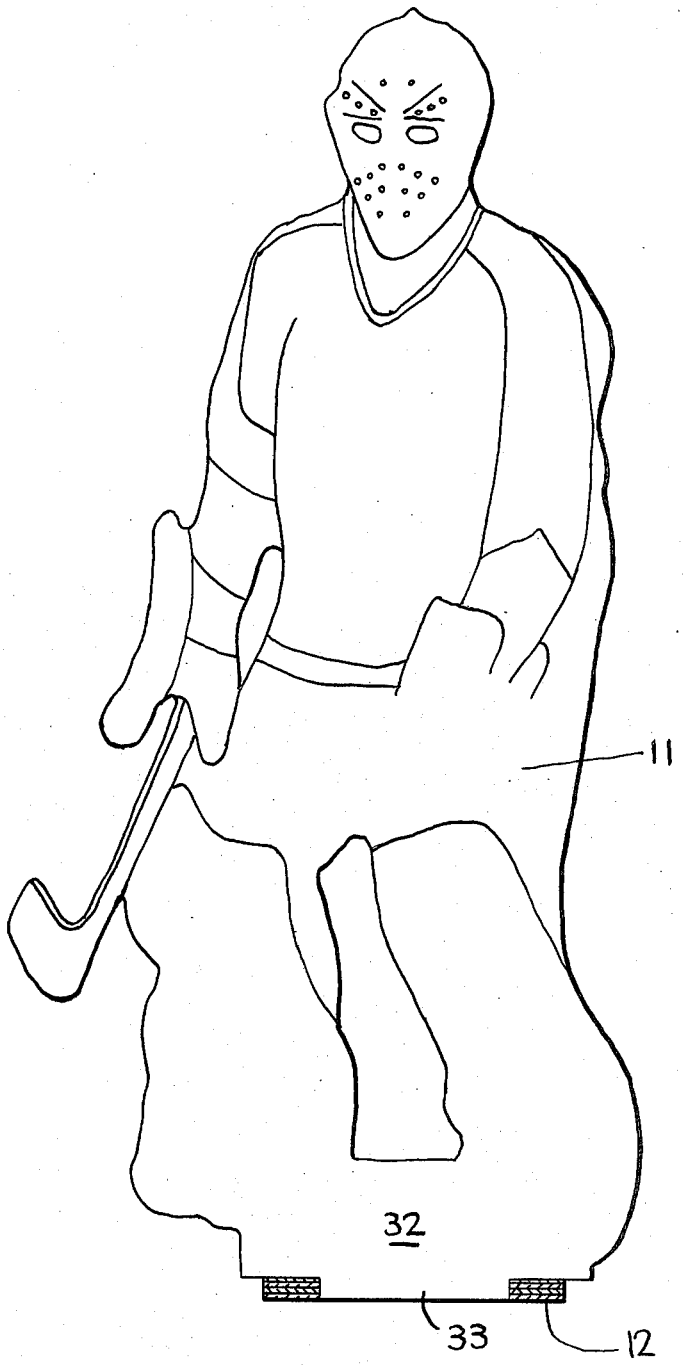
FIG. 2 is an elevational view of the cutout figure mounted upon a base element after separation of the two components from the initial panel.
Figure 3:
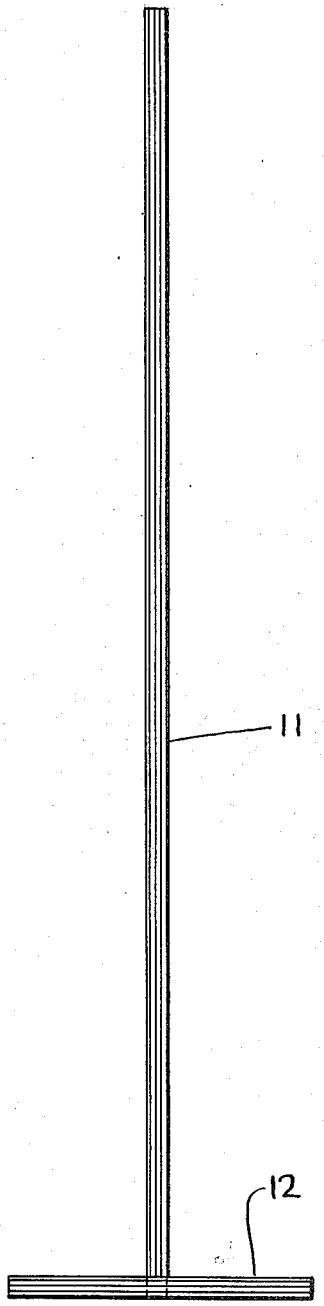
FIG. 3 is a side elevation of the structure of FIG. 2.

As shown in FIGS. 1 and 2 the figure 11 includes a base portion 32 having a tab 33 at its lower edge and, as best shown in FIG. 1, the base member 12 is slotted as at 34 to receive the tab 33 and support the figure in upright position as shown in FIGS. 2 and 3.

The regular outer shape of the panel, in the present instance rectangular but subject to various modifications, facilitates the manufacture, packaging, storage and transportation of the present display devices.

A preferred embodiment of this invention having been hereinabove described and illustrated in the drawings, it is to be understood that numerous modifications thereof can be made without departing from the broad spirit and scope of this invention as defined in the appended claims.

I claim:

1. A display device comprising a rigid inflexible panel having an irregularly shaped display figure or object depicted thereon, a series of die-cuts in said panel providing open areas surrounding a major portion of the outline of said display figure or object, and score lines outlining the remaining portions of the outline of said figure or object and connecting between said die-cuts, whereby the surrounding portion of said panel may be broken away from said display figure without flexing or bending of said figure to effect complete separation of said display figure from said panel, said panel being fabricated by die-cutting and scoring a plurality of indentical chipboard laminations in corresponding identical locations thereon and adhesively securing them to each other in laminated form to form a die-cut panel of substantial thickness and rigidity, said figure has a tab formation at the lower end thereof and said surrounding portion of said panel includes a base member having a slot therein for receiving said tab formation to support said figure in an upright position, said panel further includes a score line extending from an outer edge thereof inward to said display figure to facilitate the beginning of the separation of the surrounding panel from the display figure.

* * * * *